United States Patent [19]

Hoyt

[11] 4,101,994

[45] Jul. 25, 1978

[54] COMBINATION BEACH BAG AND BLANKET

[76] Inventor: F. Russell Hoyt, 682 Azalea Dr., Rockville, Md. 20850

[21] Appl. No.: 812,247

[22] Filed: Jul. 1, 1977

[51] Int. Cl.[2] ..... A47G 9/00
[52] U.S. Cl. ..... 5/344; 190/57
[58] Field of Search ..... 5/344; 190/57

[56] References Cited

U.S. PATENT DOCUMENTS

| | | | |
|---|---|---|---|
| 33,385 | 10/1861 | Frodsham et al. | 5/344 |
| 1,951,527 | 3/1934 | Oas | 5/344 |
| 2,540,165 | 2/1951 | Fiel | 5/344 |
| 2,788,533 | 4/1957 | Bornstein | 5/344 |
| 3,176,315 | 4/1963 | Freund | 5/344 R |

FOREIGN PATENT DOCUMENTS

| | | | |
|---|---|---|---|
| 1,063,401 | 5/1954 | France | 5/344 |
| 1,264,919 | 2/1972 | United Kingdom | 5/344 |
| 1,033,441 | 6/1966 | United Kingdom | 5/344 |

*Primary Examiner*—Casmir A. Nunberg
*Assistant Examiner*—Victor N. Sakran
*Attorney, Agent, or Firm*—Robert D. Farkas

[57] ABSTRACT

A combination beach bag and blanket construction comprising a rectangular bag portion having a stiffening member on the bottom side and receptive of gear for holding same and to alternatively provide a pillow. A flexible planar portion is connected to the bag portion and foldable into a rectangular configuration similar to that of the bag portion. A flexible carrying handle is connected to the top side of the bag portion with one end extendable around the folded blanket for use with the other end to carry the construction as a beach bag.

5 Claims, 4 Drawing Figures

COMBINATION BEACH BAG AND BLANKET

BACKGROUND OF THE INVENTION

The present invention relates to a combination beach bag and blanket construction.

Combination beach bag and blanket constructions are known in the prior art, but these known constructions have complex or unwieldly provisions for carrying the construction when folded into the beach bag configuration.

Among the known prior art constructions are those disclosed in U.S. Pat. Nos. 2,540,165; 2,783,473; 2,883,682; 2,898,609; 2,910,707; 2,041,638; 3,052,895; 3,477,552 and 3,879,775.

SUMMARY OF THE INVENTION

It is the principle object of this invention to provide a combination beach bag and blanket construction of water repellent material such as treated nylon fabric.

This and other objects are achieved by the preferred embodiment of the invention in which a blanket portion is affixed to a bag portion having a zippered portion. A handle attached to the bag serves for carrying the folded combination.

Having in mind the above and other objects that will be obvious from an understanding of the disclosure, the present invention comprises a combination and arrangement of parts illustrated in the presently preferred embodiments of the invention which are hereinafter set forth in sufficient detail to enable those persons skilled in the art to clearly understand the function, operation, construction and advantages of it when read in conjunction with the accompanying drawings.

BRIEF DESCRIPTION OF THE DRAWING

The invention will be described in detail, by way of example, with reference to the accompanying drawing in which.

DETAILED DESCRIPTION OF THE PREFERRED EMBODIMENT

Figure 1:
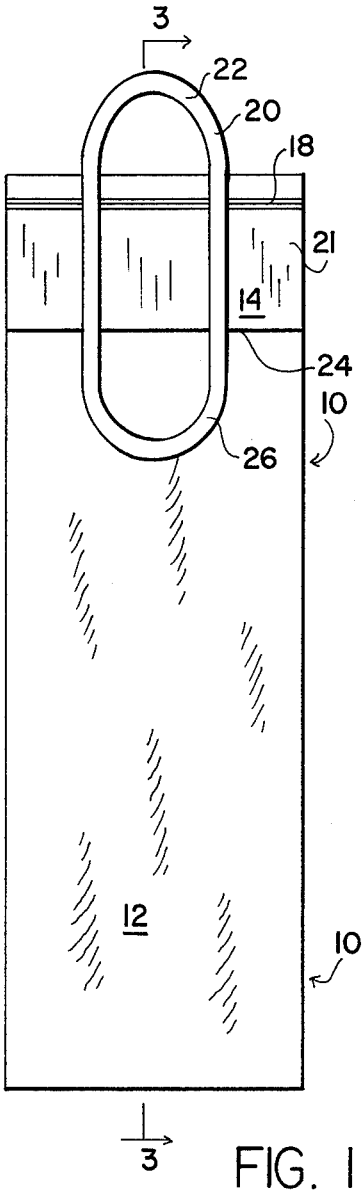
FIG. 1 is a plan view of the open construction illustrating the principles of the invention.
Figure 3:
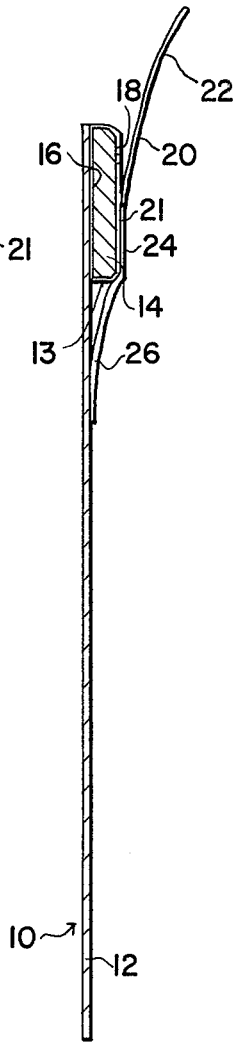
FIG. 3 is a side sectional view taken along line 3—3 in FIG. 1.

Referring to FIGS. 1 and 3 of the drawing and in accordance with the principles of the invention, a combination beach bag and blanket 10 is shown comprising a flexible rectangular blanket portion 12 made preferably of nylon fabric and connected at one shorter end to the lower edge 13 of a bag portion 14. The bag portion 14 is rectangular in shape and has a side 16 in common with the water repellent blanket portion 12 stiffened to provide rigidity to the combination 10. The bag portion 14 has a zipper closure 18 on the top for opening and closing.

Figure 2:
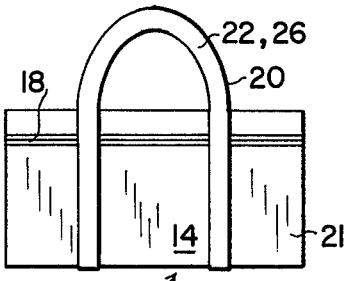
FIG. 2 is a folded view of the construction.
Figure 4:
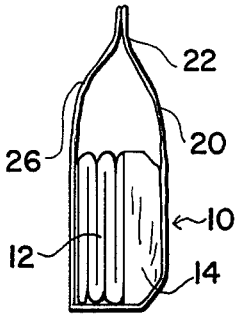
FIG. 4 is an end view of the folded construction.

A flexible carrying handle 20 made of a continuous nylon strap is connected to the top side 21 of the bag portion 14 and has a first loop portion 22 extending outwardly from an edge 24 opposite the lower edge 13 and a second loop portion 26 positioned to lie on the blanket portion 12 when unfolded and is extendable around the folded blanket portion 12 for use with the first loop portion 22 when using the beach bag and blanket 10 as a beach bag as shown in FIGS. 2 and 4.

In use, the blanket portion 12 is spread on the ground and soft articles may be put in the bag portion 14 to provide stuffing for a pillow. The blanket portion 12 may later be folded into a shape matching the shape of the bag portion 14 and the two loop portions 22, 26 deployed around the folded construction for transporting. Personal articles are carried in the zippered bag portion 14.

While the preferred embodiment is described and illustrated, it will be understood that the invention is in no way limited to this embodiment.

I claim:

1. A combination beach bag and blanket construction comprising:

a. a rectangular openable and closeable bag portion having a stiffening member on one side thereof corresponding to the bottom side of the blanket when positioned on the ground during use, said bag portion having a bottom side and a top side and being receptive of a user's gear for holding same when used as a bag and for providing a pillow on the top side when used as a blanket;

b. a flexible planar blanket portion connected to said bag portion at one edge of said bottom side and foldable into a rectangular configuration of dimension similar to that of said stiffening member; and c. a flexible carrying handle connected to said top side of the bag portion and having a first hand grasping portion extending outwardly from an edge of said top side disposed opposite said one edge and a second hand grasping portion positioned to lie on the blanket portion when unfolded and extendable around and engaging the folded blanket portion for juxtaposition with the first hand grasping portion, said first and said second hand grasping portions each having a U-shape and connected to one another to form a unitary closed loop shape comprising said carrying handle, whereby the folded blanket portion and the bag portion are maintained in side by side relationship having said first and said second hand grasping portions extending outwardly therefrom.

2. A construction according to claim 1, wherein said bag portion comprises a zipper construction on the top side of the bag portion for opening and closing same.

3. A construction according to claim 2, wherein said handle comprises a continuous flexible strap.

4. A construction according to claim 3 wherein said strap comprises nylon.

5. A construction according to claim 4, wherein said blanket portion comprises water repellent material.

* * * * *